US007090529B1

(12) United States Patent
Wang

(10) Patent No.: US 7,090,529 B1
(45) Date of Patent: Aug. 15, 2006

(54) LED CONNECTOR

(76) Inventor: Xiao-Ping Wang, No. 511, Jiatang Highway, Jiading, Shanghai (CN)

( * ) Notice: Subject to any disclaimer, the term of this patent is extended or adjusted under 35 U.S.C. 154(b) by 0 days.

(21) Appl. No.: 11/223,849

(22) Filed: Sep. 10, 2005

(51) Int. Cl.
*H01R 11/20* (2006.01)

(52) U.S. Cl. ..... 439/417; 439/490

(58) Field of Classification Search ..... 439/417–418, 439/490

See application file for complete search history.

(56) References Cited

U.S. PATENT DOCUMENTS 5,810,622 A * 9/1998 Chang ..... 439/622
2005/0287863 A1* 12/2005 Tufano et al. ..... 439/418

* cited by examiner

*Primary Examiner*—Truc Nguyen
(74) *Attorney, Agent, or Firm*—Clement Cheng

(57) ABSTRACT

The present invention is a LED connector principally comprised of two compatible halves with flat opposing surfaces, which form a complete cylinder when placed together. Its cross sectional area is no larger than that of the LED lamp.

The solid-dome shaped LED component has an annular flat bottom that holds an outwardly extended pair of leads. Two parallel L-shaped recesses extend longitudinally over the connector half's flat surface. A large groove aligned with longer recess is included to accommodate the resister's solder. A pair of strategically spaced slots are formed longitudinally in the connector half's central region. The top slot holds a first conductive terminal member, and the bottom slot holds a second terminal member with their bases, respectively.

The opposing connector's flat surface bears the same layout of recesses, slots and grooves. When the connector's halves are adjoined, electrical connections between the LED lamp and wires can be firmly secured and insulated. This interaction is conducted within the radius of the LED component, and is easily reversed by simple rewiring via the unique fastening means. Fastening means include three perpendicularly protruding posts with corresponding pinholes within the connector. Each of said posts and pinholes are individually sized and located in corresponding orientations of the first and second connector halves.

14 Claims, 3 Drawing Sheets

LED CONNECTOR

BACKGROUND OF THE INVENTION

A. Field of the Invention

The present invention relates to an electric component, and more particularly to a miniature pin-mount connector for light emitting diodes used in electric signage or other displays.

B. Description of the Prior Art

Small light bulb arrays with supporting sockets are previously identified in the art, as suggested by U.S. Pat. No. 2,265,360 to F. M. Dessart and U.S. Pat. No. 2,506,620 to E. V. Sundt. Their primary uses are for Christmas ornaments that connect multiple small bulbs in parallel to a pair of electric wires by their respective terminal structures or sockets. The wires are enclosed either permanently in the sockets' manufacture, yielding a molded structure, or semi-permanent structure. Both methods generally require heat energy in setting the sockets to hold the electric wires in place.

These and other prior art sockets are designed for holding separate bulbs at a distance from each other. The introduction of the semiconductor and subsequent development of light emitting diodes (LEDs) have made this the preferred light source in many areas that desire simple and economical display lighting. LEDs are commonly used for illuminating signs, traffic signals, automobile taillights and display lights. One such application is electric signage, wherein a designed array of LEDs are safely energized by a 12-volt DC source to display characters and/or shapes recognizable from distant locations. A single LED is comprised of a small transparent solid lamp with two leads extending outwardly.

Wiring of the LEDs to the power source can be facilitated by utilizing connectors or sockets, one of which is suggested by U.S. Pat. No. 5,944,463 to Savage, Jr. In this patent, LED is housed with a pair of electric wires between two clamping elements. Metal terminals are also provided to automatically make electrical connections between the electric wire cores and the LED leads. When the clamping elements of the terminal are closed toward each other and a latching mechanism locks them in position, an electrical connection is created. This prior art connector may be suitable for a single dot of light, however it does not provide for a LED array wherein numerous dots of LEDs are packed tightly into plain layout areas. Such design is necessary to create the continuous lines of letters or shapes in electric signs, as well as many other modern LED devices.

A problem lies within conventional LED connectors when they are applied to electric signage. They are unable to array the LEDs in necessary lateral proximity because conventional LED connectors' inherently large latitudinal space keeps the LEDs from adjoining each other. Additionally, conventional connectors are quite expensive compared to the cost of LEDs themselves, which have been steadily decreasing in price with the improvement of manufacturing.

A new, lower cost microstructure of LED connector is therefore needed for universal applications in single to large volumes, including electric signage.

It is the primary object of the present invention to provide a miniature LED connector with a latitudinal cross section area no larger than the LED itself.

An additional objective is to provide an LED connector that can be manufactured at a fraction of the cost of the LED.

The final objective of the present invention is to provide an LED connector that ensures high security electrical connection, while still allowing instant uninstallation without the additional aid of special tools or heat energy.

SUMMARY OF THE INVENTION

The present invention is a LED connector principally comprised of two compatible halves, which form a cylinder when placed together. Its cross sectional area is no larger than that of the LED lamp. The connector halves bear flat opposing surfaces that come into full contact with each other upon assembly.

The lamp has a LED component in the shape of a solid dome. The dome's annular flat bottom accommodates a pair of leads that extend outwardly. The first lead bears a curvature at a predetermined distance near its distal end, which prepares it for electrical connection. A second lead may have a resister soldered to its distal end, which supplies a regulated electric current to the LED. The second lead is also prepared for electrical connection with a curvature formed at the free lead of the resister.

An L-shaped recess is formed on the connector half's flat surface, generally extending longitudinally so that the entire length of the first lead can be inlayed. In parallel to the L-shaped recess, an additional inverted L-shaped recess is formed which extends over a substantial portion of the connector half's longitudinal length. There is a larger groove aligned with the longer recess to accommodate the resister's solder.

A pair of strategically spaced slots are formed longitudinally in the connector half's central region. The top slot holds a first conductive terminal member, and the bottom slot holds a second terminal member with their bases, respectively. Each terminal member is generally rectangular in shape with one side left open to form Y-shaped inner edges. Such edges are adapted to slit a wire through its insulation sheath as it is depressed during assembly, providing a direct contact with the inner conductive core. The LED lamp is energized when the bend of the first lead secures an electrical connection with the wire by following the same passage of the core into terminal member's edges positioned in the slot.

The same principle applies to the subassembly of the second lead and resister. The bend of the lead may be depressed down the terminal member's slitting edges that are seated in the corresponding slot and held the other wire at its core earlier as the opposite wire was engaged.

In addition, a transverse groove is formed on the connector half coextending with sections of the L-shaped recess, the top slot and the longer recess. The groove receives the wire over the half of its round outside surface. Similarly, a second transverse groove is formed on the connector half coextending with sections of the longer recess and bottom slot. The second groove receives another wire over substantially the half of its round outside surface.

The flat surface of the opposing connector half has the same layout of recesses, slots and grooves. When the two connector halves are adjoined with all electrical components in position, the electrical connections between the LED lamp and the wires can be firmly secured and insulated. This interaction is completely conducted within the radius of the LED component, and can additionally be reversed by simple rewiring via the unique fastening means of the present invention.

A pushpin type of fastening means is employed to link the connector halves in assembly. Three posts extend upright from the first connector half's flat inner surface, which correspond to the second connector half's complementary pinholes to hold the posts. A top post protrudes at a right angle from the longitudinal center of the upper area of the connector half's flat surface and has a first thickness. The second connector half's complementary position contains a hole with an exact diameter set to create and maintain a firm fit with the top post. The distal end of the top post may extend beyond the thickness of the second connector half penetrating the opposite opening of the pinhole. Any such overextended portion may be used later as a releasing push button in case a disassembly of the connector is necessary for replacements of LED or other purposes.

A middle post similarly protrudes from the connector half, but is thicker than the top post and serves as a middle anchor for reinforced fastening. Therefore, the protruding height of the middle post may be lower than the top post and is adapted for insertion into the corresponding pinhole on the second connector half. The post is not necessarily opened throughout its thickness. Additionally, the middle post is positioned off center from the longitudinal location of the top post in order to prevent the two connector halves from being engaged in a wrong orientation wherein the middle post is led to impede other flat regions of the second connector half than its pinhole.

A bottom post has a third thickness different from those of the top and middle posts to further enhance the orientation correction feature. This post is positioned in the longitudinal center and will be engaged with the corresponding hole on the second connector half in assembly. The distal end of the bottom post may extend beyond the thickness of the connector half that penetrates the opposite opening of the hole. Any such overextending portion may be used later as a releasing push button as well.

Thus, a complete LED circuit may be established by connecting one pair of the wire's free ends to a power source, such as a 12-volt power module, through an on-off switch. This leaves another pair of the wire's free ends, which be connected in parallel electrically to a predetermined number of LED lamps in close physical proximity with assistance of the connectors of the present invention.

DETAILED DESCRIPTION OF THE PREFERRED EMBODIMENT

Figure 1:
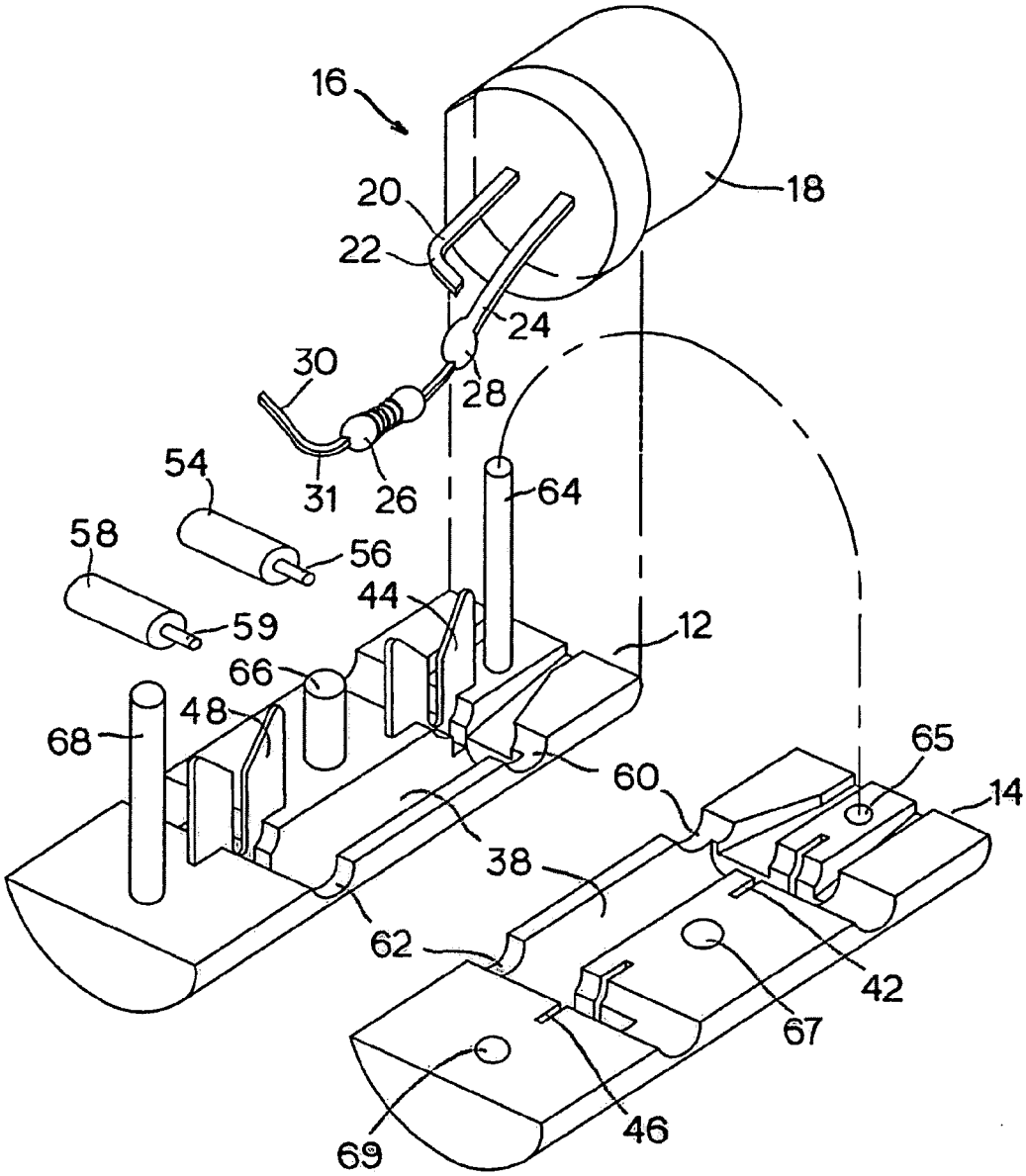
FIG. 1 is a perspective view of a miniature LED connector according to a preferred embodiment of the present invention showing its housing halves and a lamp subassembly of an LED and resister before fastening together.

Referring to FIG. 1, the LED connector 10 mainly comprises a first half section 12 and a second half section 14 forming together a round column having flat top and bottom ends and its cross sectional area no larger than that of a lamp 16. The connector halves 12 and 14 have generally flat opposing surfaces, which come into full contact with each other when they are assembled.

The lamp 16 has an LED 18 in the shape of a solid dome with an annular flat bottom and a pair of leads extending outwardly from the flat bottom. A first lead 20 is prepared for electrical connection with a bend 22 formed at a predetermined distance near its distal end. A second lead 24 may have a resister 26 soldered at a point 28 to its distal end to supply a regulated electric current to the LED 18. The second lead 24 is prepared for electrical connection via a bend 30 formed at a free lead 31 of the resister 26, which will be scrutinized in further detail below.

Figure 2:
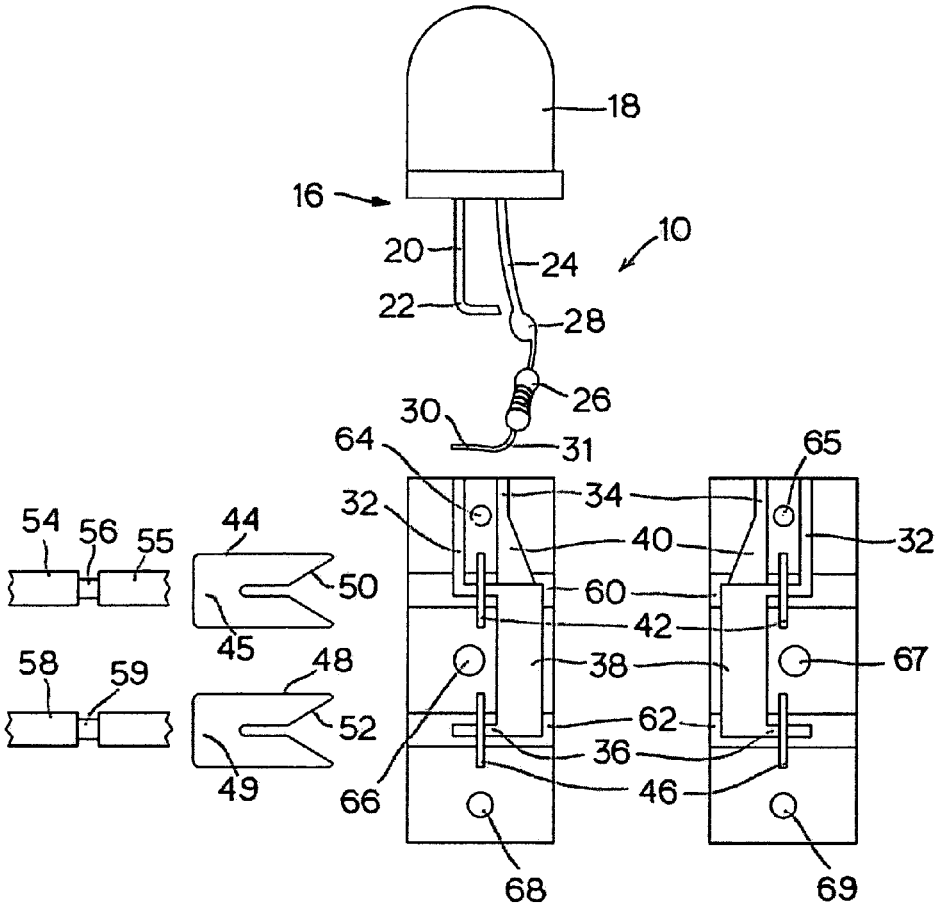
FIG. 2 is a plan view of the housing halves of FIG. 1 showing the recess layout and its relations to the lamp subassembly more clearly.

To retain the lead 20, on the inner flat surface of the connector half 12 is formed an L-shaped recess 32 extending downwardly longitudinally from the top flat end of the connector half 12 for inlaying the entire length of the lead 20 as is clearly shown in FIG. 2. In parallel to the recess 32, an inverted L-shaped recess 34 is formed to extend over substantial portion of longitudinal length of the connector half 12 ending at its bottom 36. In line with the recess 34, there is a larger groove 38 formed to accommodate the resister 26 and solder 28 at the lead 24.

Thus the recess 34 includes the relatively narrow top section for a tight fit with the proximal end of the lead 24, a transition 40 into the groove 38 and the bent bottom 36 to receive the bend 30 of the resistor 26 in series. Centrally of the connector half 12 a pair of spaced slots are formed longitudinally. Top slot 42 holds a first conductive terminal member 44 with its base 45 and bottom slot 46 holds a second terminal member 48 with its base 49.

The terminal members 44 and 48 are shown with their sides laid flat in FIG. 2 wherein the terminal 44 has a generally rectangular shape leaving one side open to form Y-shaped inner edges 50. These edges 50 are adapted to slit a wire 54 through its insulation sheath 55 as it is depressed during assembly in order to provide a direct contact with the inner conductive core 56. By following the same passage of the core 56 into the edges 50 of the terminal member 44 positioned in the slot 42, the bend 22 of the lead 20 may secure an electrical connection with the wire 54 to energize the lamp 16.

The same principle applies to the subassembly of the lead 24 and resister 26 wherein the bend 30 of the lead 31 may be depressed down the slitting edges 52 formed in the terminal member 48 which was seated in the corresponding slot 46 and held the other wire 58 at its core 59 earlier as the opposite wire 54 was engaged.

In addition, a transverse groove 60 is formed on the connector half 12 coextending with sections of the recess 32, top slot 42 and recess 34 to receive the wire 54 over substantially the half of its round outside surface. This positioning of the groove 60 is important in the achievement of miniaturization of the connector of the present invention. Similarly, a transverse slot or groove 62 is formed on the connector half 12 coextending with sections of the recess 34 and bottom slot 46 to receive the wire 58 over substantially the half of its round outside surface.

The flat surface of the second connector half 14 has the same layout of the recesses, slots and grooves in the mirror image of the first connector half 12. When the two connector halves are adjoined with the electrical components in position, the electrical connections between the lamp 16 and the wires 54 and 58 can be firmly secured and insulated completely within the radius of the LED 18. The connections can be easily reversed in rewiring for any reason with the assistance of a unique fastening means of the present invention as described below.

Figure 3:
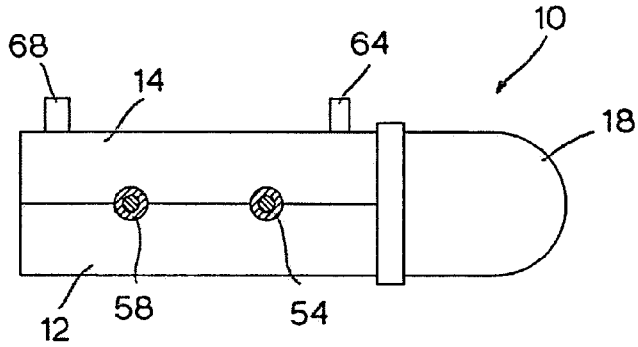
FIG. 3 is a side view of the LED connector of FIG. 1, which is fully assembled connecting the wires to the LED component.

To simplify the connector structure as well as the method of connection, a pushpin method of fastening the halves is employed. Extending upright from the flat inner surface of the connector half 12 are three posts for making engagements with the other connector half 14, which has corresponding pinholes to hold the posts. A top post 64 protrudes at a right angle from an upper area of the flat surface of the connector half 12 in its longitudinal center and has a first thickness. At the corresponding position on the mating connector half 14 a through hole 65 is formed having its diameter set to maintain a tight fit with the post 64 when it is press fit throughout the thickness of the connector half 14. The distal end of the post 64 may extend beyond the thickness of the connector half 14 penetrating the opposite opening of the hole 64, as shown in FIG. 3. Such overextending portion may be used later as a releasing push button in case a disassembly of the connector is necessary for replacements of LED or other purposes.

A middle post 66 similarly protrudes from the connector half 12 but it is thicker than the top post 64 as a middle anchor for reinforced fastening. Therefore, the protruding height of the middle post 66 may be lower than the top post 54 and it is adapted to be inserted into the corresponding pinhole 67 on the connector half 14, which is not necessarily opened throughout its thickness. Additionally, the middle post 66 is positioned off center from the longitudinal location of the top post 64 in order to prevent the two connector halves 12 and 14 from being engaged in a wrong orientation wherein the post 66 is led to impede other flat regions of the connector half 14 than its hole 67.

Providing a bottom post 68, which has a third thickness different from those of the posts 64 and 66, further enhances the orientation correction feature. The post 68 is positioned in the longitudinal center and will be engaged with the corresponding pinhole 69 on the connector half 14 in assembly. The distal end of the post 68 may extend beyond the thickness of the connector half 14 penetrating the opposite opening of the pinhole 69. Any such overextending portion may be used later as a releasing push button also. The slots 42 and 46 formed on the second connector half 14 are adapted to receive the terminal members 44 and 48 at their distal edges 50 and 52 respectively to keep the leads 20 and 30 and the wire cores 56 and 59 within secure electrical contacts.

In operation, the first connector half 12 is fitted with a pair of the terminal members 44 and 48 and the lamp subassembly 16 is press fit onto the terminal members. Then, the second connector half 14 may be brought into a provisional engagement with the first connector half 12 wherein the posts 64, 66 and 68 of the first half 12 are inserted partially into the corresponding pinholes 65, 67 and 69 of the second half 14. This is in preparation of its future permanent electrical connection with the wires 54 and 58, when the second connector half 14 may be immediately pulled out with ease. Then, terminal members 42 and 48 of the connector half 12 may be brought into the correct locations along the wires 54 and 58. The reengagement of the second connector half 14 toward the first half 12 with wires 54 and 58 sandwiched therein makes a straight slitting action to the sheaths of the wires, establishing a desired secure electrical contact with the wire cores.

It is understood that the above sequence of assembly will be varied to adapt to the different possible applications of the connector of the present invention.

Thus, a complete LED circuit may be established by connecting one pair of free ends of the wires 54 and 58 to a power source, such as a 12-volt power module, through an on-off switch. The remaining pair of free ends of the wires 54 and 58, to which a predetermined number of lamps 16 can be connected in parallel electrically and in close proximity physically with the assistance of the connectors 10 of the present invention. The footprint of the LED in the lighted sign is a function of its radius and the connector is preferably the same radius and footprint as the LED. Thus, when the LED protrudes through a surface of the lighted sign, the connectors can be applied or secured next to each other so that they touch. The small footprint is also valuable when the LED is placed behind the surface of the lighted sign because the LED pattern can be controlled to a greater degree if the connectors can be applied or secured next to each other so that they touch.

Figure 4:
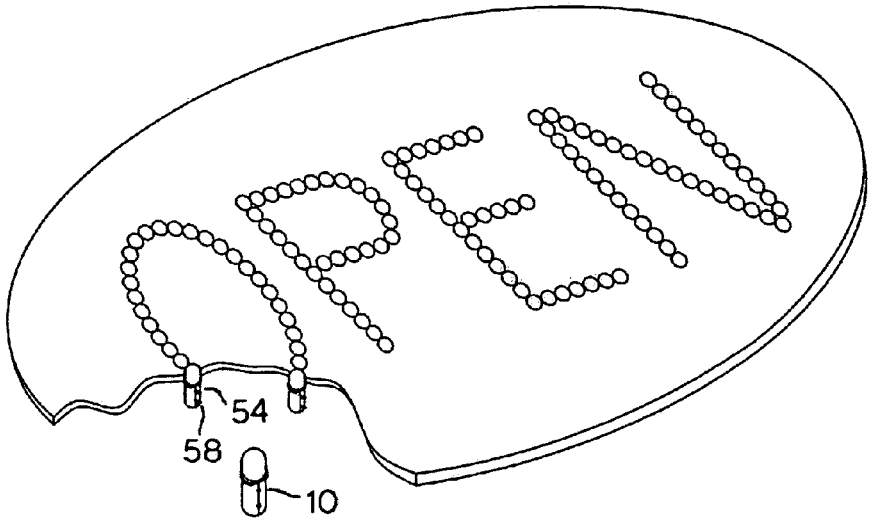
FIG. 4 is a perspective view of an exemplary application of the LED connector to an electric sign system.

Arranging the LED-connector assemblies to display specific messages can be done following methods well known in the art of sign fabrication. FIG. 4 shows a popular sign device employing the LED connector of the present invention. Besides simply miniaturizing the connector's volume, the desired high concentration of LED lamps is achieved by the cylindrical configuration of the inventive connector 10 and its internal layout. An electric conduction is routed through the smallest distance permissible, and the electric wires along with LED leads are arranged to coextend at the terminal members while maintaining a secure electrical contacts among them. Therefore, while the presently preferred form of the LED connector has been shown and described, persons skilled in this art will readily appreciate that various additional changes and modifications can be made without departing from the spirit of the invention, as defined and differentiated by the following claims.

The invention claimed is:

1. A miniature connector for LED (light emitting diode) having a dome lamp portion with an annular flat bottom and a pair of conductor leads extending outwardly of said flat bottom comprising:

a. a first connector member having an outer round surface and an inner rectangular flat surface with its latitudinal profile corresponding to one half of said annular bottom area of said light emitting diode, said inner flat surface including inlaying sections for said conductor leads of said light emitting diode to extend longitudinally under predetermined depths of said inner flat surface;

b. a second connector member shaped symmetrical to said first connector member to have a mirror image of said inlaying sections;

c. a fastening means to releasably join said first and second connector members together having a number of posts protruding perpendicularly from said inner flat surface of said first connector section and pinholes at corresponding locations on said second connector section, each of said posts and pinholes being individually sized and located to guide the correct relative orientations of said first and second connector members during their mating process of assembly; and d. a conduction means for connecting said leads to a pair of electric wires, said conduction means having a pair of conductive terminal members adapted to be held apart from each other longitudinally in said first and second connector members and having slitting edges for making secured electrical contacts with said wires, which are clipped forcibly in between said first and second connector members, whereby desired number of said connectors can be positioned laterally in close proximity during and after assemblies of said light emitting diodes in an array along said electric wires.

2. The miniature connector for LED set forth in claim 1, wherein each of said first and second connector members further has a pair of transverse grooves formed on its inner flat surface transecting said inlaying sections to receive the wire upon the assembly of said connector members.

3. The miniature connector for LED set forth in claim 1, wherein said fastening means has three sets of posts on said first connector member and corresponding pinholes extending at least part of the thickness of said second connector member with inner openings for tights fit around said posts and said posts includes a top post protruding from an upper area of said flat inner surface of said first connector member in its longitudinal center and having a first thickness, a middle post similarly protruding from said first connector member at a position off center from the longitudinal location of said top post and having a thickness more than that of said top post for a reinforced fastening, and a bottom post, which has a third thickness different from those of the top and middle posts at a position in said longitudinal center, whereby preventing the two connector members from being engaged in a wrong orientation in assembly.

4. An LED connector comprising:

a. an LED having a pair of conductor leads;

b. a first connector member having grooved sections receiving the conductor leads of the LED that extend longitudinally across the first connector member;

c. a second connector member of substantially symmetrical shape as the first connector member, wherein the second connector member has grooved sections receiving the conductor leads of the LED;

d. a fastener that joins the first and second connector members together, wherein the fastener has a number of posts at the first connector member shaped to join with corresponding holes on the second connector member; and e. a pair of conductors electrically connecting each conductor lead to one of a pair of electric wires.

5. The LED connector of claim 4, wherein the pair of conductors terminal members are adapted to be held apart from each other longitudinally within the first and second connector members and having slitting edges for making secured electrical contacts with the electric wires.

6. The LED connector of claim 4, wherein the connectors have the same footprint as the LED and are positioned laterally in close proximity during assembly.

7. The LED connector of claim 4, wherein each of the first and second connector members further has a pair of transverse grooves formed on an inner flat surface transecting the inlaying sections to receive wire upon the assembly of the connector members.

8. The LED connector of claim 4, wherein the fastener has three sets of posts in asymmetrical configuration and shape allowing only proper orientation during connector member assembly.

9. The LED connector of claim 8, wherein the fastener has three sets of posts on the first connector member and corresponding pinholes extending at least part of the thickness of the second connector member with inner openings for tight fit around the posts and the posts includes a top post protruding from an upper area of the flat inner surface of the first connector member in its longitudinal center and having a first thickness, a middle post similarly protruding from the first connector member at a position off center from the longitudinal location of the top post and having a thickness more than that of the top post for a reinforced fastening, and a bottom post, which has a third thickness different from those of the top and middle posts at a position in the longitudinal center, whereby preventing the two connector members from being engaged in a wrong orientation in assembly.

10. An LED sign comprising:

a. an LED having a pair of conductor leads;

b. a first connector member having grooved sections receiving the conductor leads of the LED that extend longitudinally across the first connector member;

c. a second connector member of substantially symmetrical shape as the first connector member, wherein the second connector member has grooved sections receiving the conductor leads of the LED;

d. a fastener that joins the first and second connector members together, wherein the fastener has a number of posts at the first connector member shaped to join with corresponding holes on the second connector member;

e. a pair of conductors electrically connecting each conductor lead to one of a pair of electric wires; and f. a sign member having a surface with perforations shaped to retain multiple LEDs, wherein the LEDs protrude through the perforations when assembled.

11. The LED connector of claim 10, wherein the pair of conductors terminal members are adapted to be held apart from each other longitudinally within the first and second connector members and having slitting edges for making secured electrical contacts with the electric wires.

12. The LED connector of claim 10, wherein the connectors have the same footprint as the LED and are positioned laterally in close proximity during assembly.

13. The LED connector of claim 10, wherein each of the first and second connector members further has a pair of transverse grooves formed on an inner flat surface transecting the inlaying sections to receive wire upon the assembly of the connector members.

14. The LED connector of claim 10, wherein the fastener has three sets of posts in asymmetrical configuration and shape allowing only proper orientation during connector member assembly.

* * * * *